US010694806B2

(12) United States Patent
Moore

(10) Patent No.: US 10,694,806 B2
(45) Date of Patent: Jun. 30, 2020

(54) SHOE OR SANDAL WITH INTERCHANGEABLE STRAPS AND ORNAMENTS

(71) Applicant: Linda Faye Moore, Henderson, NV (US)

(72) Inventor: Linda Faye Moore, Henderson, NV (US)

( * ) Notice: Subject to any disclaimer, the term of this patent is extended or adjusted under 35 U.S.C. 154(b) by 198 days.

(21) Appl. No.: 15/683,763

(22) Filed: Aug. 22, 2017

(65) Prior Publication Data

US 2018/0289101 A1 Oct. 11, 2018

Related U.S. Application Data

(60) Provisional application No. 62/378,020, filed on Aug. 22, 2016.

(51) Int. Cl.
*A43B 3/24* (2006.01)
*A43B 3/12* (2006.01)

(52) U.S. Cl.
CPC ..... *A43B 3/242* (2013.01); *A43B 3/122* (2013.01); *A43B 3/126* (2013.01); *A43B 3/24* (2013.01); *A43B 3/244* (2013.01)

(58) Field of Classification Search
CPC ..... A43B 3/242; A43B 3/122; A43B 3/244; A43B 3/126
USPC ..... 36/100, 101, 3 A; 24/68 SK
See application file for complete search history.

(56) References Cited

U.S. PATENT DOCUMENTS 2,049,347 A * 7/1936 Benjamin ..... A43B 1/0027 36/58.5
2,140,164 A * 12/1938 Moffatt ..... A41F 1/006 24/199
5,826,597 A * 10/1998 Chou ..... A45D 8/36 132/273
5,913,316 A * 6/1999 Chou ..... A45D 8/00 132/273
7,823,299 B1 * 11/2010 Brigham ..... A43B 3/105 36/100
8,413,350 B2 * 4/2013 Scozzafava ..... A43B 3/122 36/101
2005/0016032 A1 * 1/2005 Cox ..... A43B 1/0027 36/136
2005/0039345 A1 * 2/2005 Jones ..... A43B 1/0027 36/11.5

(Continued)

*Primary Examiner* — Jameson D Collier
*Assistant Examiner* — Jocelyn Bravo

(57) ABSTRACT

The present invention is a shoe/sandal system with interchangeable reversible decorative straps and ornaments enabling the upper aesthetic appearance to be changed on a plurality of heel styles. The reversible decorative straps and their attachment devices comprised of a rectangular hook and an elastic band of the same width go over the over the top of permanently affixed straps to ensure a consistent fit and protection to the soft tissues of the foot from hard or abrasive binding surfaces of interchangeable decorative materials and attachment devices. Because there are at least two permanently affixed straps on each shoe/sandal and the interchangeable straps are reversible, this system provides a wearer with a wide variety of customizable color, pattern, texture, and design mix-and-match options in changing the aesthetic appearance shoe/sandal.

3 Claims, 8 Drawing Sheets

(56) References Cited

U.S. PATENT DOCUMENTS

Figure 3A:
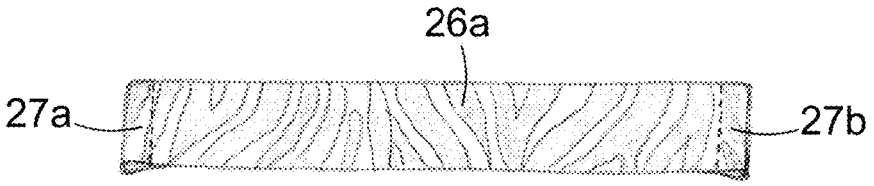

| | | | | |
|---|---|---|---|---|
| 2006/0059720 | A1* | 3/2006 | Phelan | A43B 3/122 36/101 |
| 2007/0094897 | A1* | 5/2007 | Nakatsu | A43B 1/0054 36/100 |
| 2009/0038181 | A1* | 2/2009 | Loughnane | A43B 3/103 36/94 |
| 2011/0314698 | A1* | 12/2011 | Cox | A43B 1/0027 36/100 |
| 2017/0079380 | A1* | 3/2017 | Wojcieszak | A43C 11/004 |

* cited by examiner

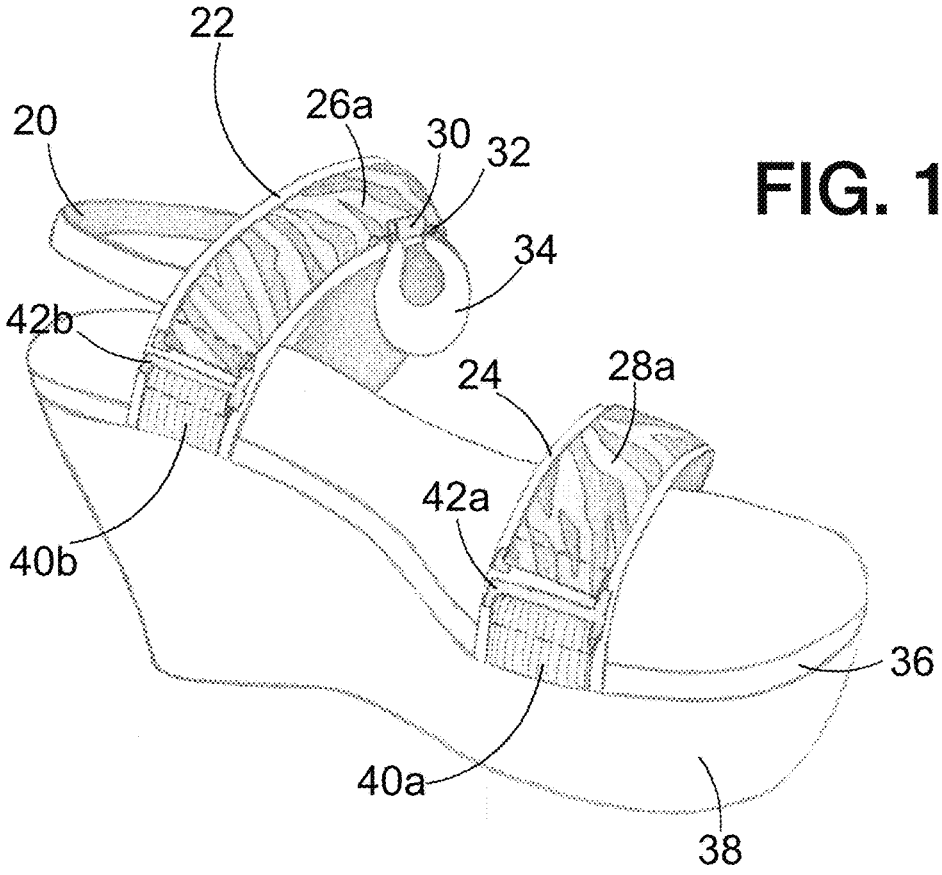
FIG. 1a
FIG. 1b
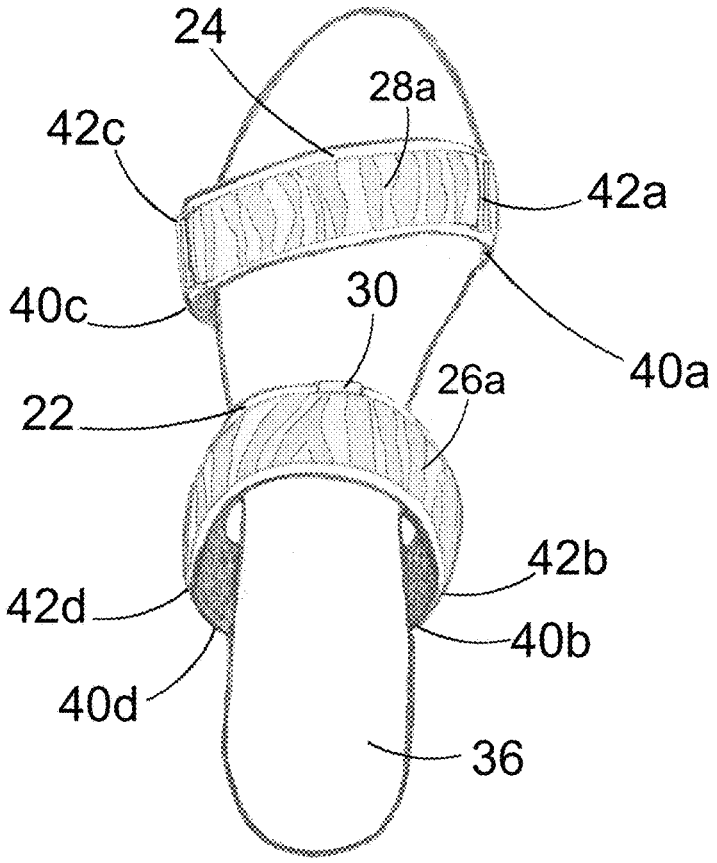

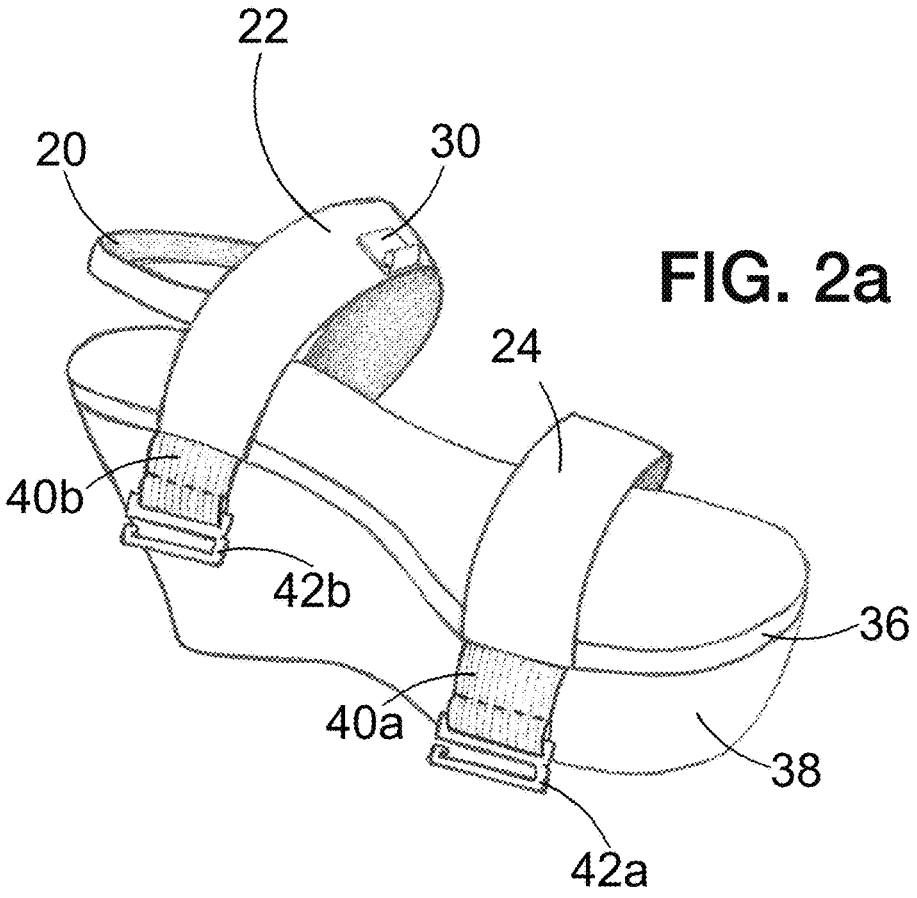
FIG. 2a
FIG. 2b
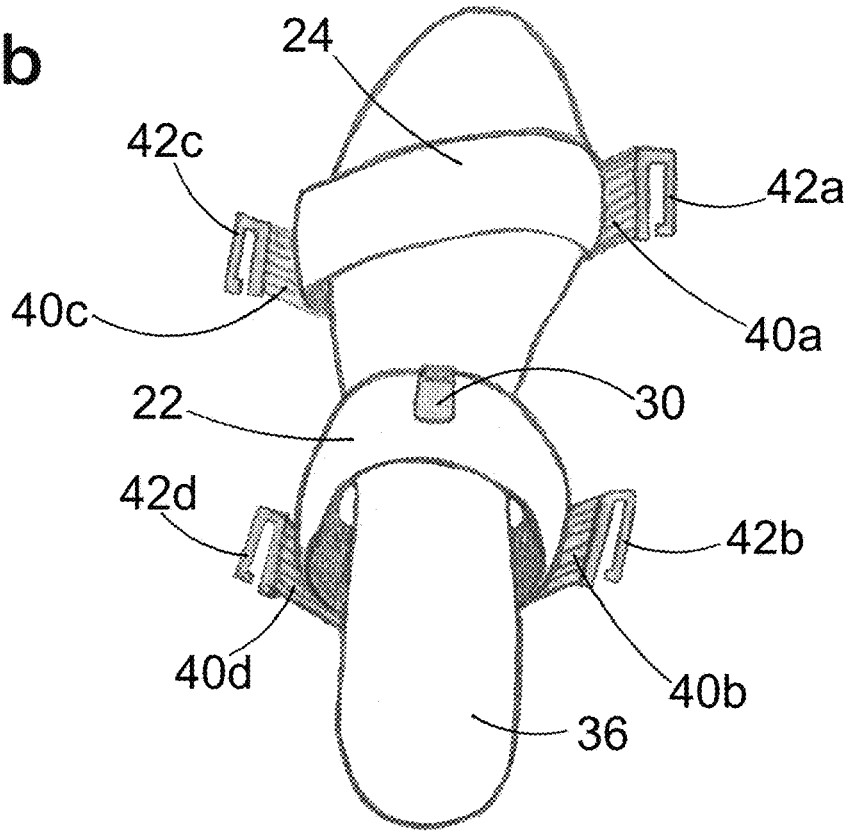

SHOE OR SANDAL WITH INTERCHANGEABLE STRAPS AND ORNAMENTS

CROSS REFERENCE TO RELATED APPLICATIONS

This application claims priority to U.S. Provisional Patent Application No. 62/378,020, filed Aug. 22, 2016 and entitled Shoe With Interchangeable Straps and Ornaments, the entire contents of which are hereby incorporated by reference.

STATEMENT REGARDING FEDERALLY SPONSORED RESEARCH OR DEVELOPMENT (Not applicable)

BACKGROUND OF THE INVENTION

The field of the present invention relates generally to footwear and more particularly to a system for easily interchanging ornaments and reversible, decorative straps over the top of permanently affixed straps on a shoe/sandal to achieve a wide variety of aesthetic appearances, optimal comfort, and consistent fit.

Most shoes and sandals are one fixed style with decorations and designs to enhance the beauty of the shoe, but they are permanently attached to the shoe and cannot be changed. The typical fashion-conscious individual enjoys coordinating footwear with their outfits, however, most people cannot afford to buy a different pair of shoes to match every outfit. Additionally, storing and/or traveling with many pairs of shoes is difficult for the average person.

The present invention provides a shoe/sandal that meets the fashion needs of a wearer who desires to achieve many different looks inexpensively, to travel with many footwear options, and who doesn't desire to take up a lot of closet and suitcase space with several individual pairs of shoes in different colors and styles.

Prior art exists that allows the upper covering of a shoe or sandal to be changed to achieve varying styles, colors and patterns, but the time it takes to assemble and disassemble, the number of styles that can be achieved, the comfort of the interchangeable uppers, and the fit of the interchangeable uppers are compromised or limited due to their restrictive designs.

It is an advantage to a wearer to have the ability to change the upper covering of a shoe/sandal to suit their needs for variety of styling and ease of traveling with many style options as well as storing many style options efficiently. However, in our fast paced world, people don't have the time to engage in a long process that may be required to assemble and disassemble various upper coverings of a shoe/sandal as is the case with some prior art.

US 2012/0079738 A1 is referenced as it displays a complex method of weaving the decorative and binding portion of the invention through multiple openings to achieve both binding of the foot to the sole and a distinctive knotted appearance. This invention does not provide the wearer with a significantly quick method of attachment nor interchangeability. The nature of complexity with this invention also requires a learning curve in order to achieve the different knotted looks or styles.

U.S. Pat. No. 6,499,234 B2 to Manzi and US 2012/0079738 to Alberi are referenced as they depict a singular strap that weaves through multiple openings or slots in the sole to achieve both the binding of the foot to the sole and the decorative element. These inventions suggests an above average amount of dexterity is required to achieve the desired function and look whereby a reasonable amount of speed and simplicity is not easily achieved with these designs in order to accomplish the intended function and appearance.

The advantages of being able to interchange the upper covering of a shoe/sandal are apparent in prior art, but much of the art reveals a limited number of styling options due to an upper covering's function as not only the decorative element, but as the binding force that secures the foot to the sole. As the binding force, one side of the decorative upper covering will touch the soft tissues of the foot. This limits that side to only using materials that can avoid discomfort of the foot if the upper covering is designed to be worn in a reversed position. If it is not designed to be worn in a reversed position, the wearer has only one styling choice with one interchangeable upper covering. Even if an upper covering is designed to be worn in a reversed position, the materials that can be used are limited due to both sides being exposed to soft tissues of the foot when the upper covering is used as both the decorative element and the binding force that holds the foot to the sole in either the front or reversed position. For example, if an interchangeable upper covering is reversible and has any abrasive materials on either side of the upper covering, including but not limited to sequins, chains, rhinestones, pointed studs, metal buckles, snaps, Velcro, or any other similar hard clasping device, such materials would come in contact with the soft tissues of the foot and could cause discomfort and possible abrasion to the foot due to friction created by back and forth or up and down motion of the foot when the wearer is walking or standing. Moreover, any such clasping device would not be easy to engage or properly function if it was in a reversed position. Prior art that is referenced so as to illustrate the limitations of materials used due to an upper covering functioning as both the decorative element and the binding force that holds the foot to the sole are exemplified in U.S. Pat. No. 4,461,102 to DeVincentis, U.S. Pat. No. 8,661,715 B2 to Roth, U.S. Pat. No. 6,499,234 B2 to Manzi, and US 2012/0216429 A1 to Zamora/Alanis.

Prior art with designs of interchangeable upper coverings require some type of attachment device to secure the upper covering to the sole of the shoe. Strong materials such as metals and hard plastics are commonly used in attachment devices to securely hold the upper coverings in their proper position. Some prior art designs dispose attachment devices in such a way as to contact an area or areas of the foot, which can contribute to abrasion of soft tissues of the foot where contact and/or friction occurs, causing discomfort to the wearer. U.S. Pat. No. 8,250,780 B1 to Diaz, US 2012/0216429 A1 to Zamora/Alanis, and U.S. Pat. No. 8,661,715 B2 to Roth exemplify designs that create this problem. Diagrams depicting the placement of attachment devices made of hard materials disposed in such a way as to make contact with areas of the foot are clearly illustrated in the abovementioned applications. These inventions expose the wearer to the abrasion and discomfort matters described above.

U.S. Pat. No. 6,769,204 B1 to Phillips is an example of prior art utilizing a strap permanently affixed to a flip flop whereby a decorative strap is affixed to the permanent strap by utilizing the fastening function of loop-and-hook fasteners, otherwise known as Velcro. This method of engagement does protect the wearer's foot from coming in contact with the interchangeable decorative straps as well as the Velcro attachment device, and the interchangeable straps do not function as the binding force that holds the foot to the sole, much as the present invention, however, there is a limitation in the Phillips prior art that does not allow practical application of a reversible strap.

With a reversible configuration of the Phillips design, because hook and loop attachment requires one surface to expose either the hook or loop material, the design would suffer from being limited to colors or designs that are restricted to those made of hook-and-loop. In most cases the hook-and-loop would not serve to be aesthetically acceptable, as the commonly intended design of hook-and-loop fasteners is to be hidden from view when engaged in the act of fastening.

Yet, another problem created when an interchangeable upper covering is used as both the decorative element and the binding force to hold the foot to the sole is that of inconsistent fit. Because of the inconsistencies at the manufacturing stage, precise dimensions cannot be assured between one set of interchangeable uppers as compared to another set of the same, even though the advertised or labeled size is the same. Also, there will be inconsistencies in fit based on the materials used for interchangeable uppers. An example of this problem becomes apparent when using spandex or elastic type materials for interchangeable uppers as opposed to non-stretch materials such as nylons and polyesters. It becomes a challenge for the wearer to therefore obtain a consistent fit when upper coverings are made with both stretch and non-stretch materials and when the upper coverings are also used as the binding force to hold the foot onto the sole of the shoe/sandal. This limits the decorative materials prior art may use for interchangeable upper coverings.

Prior art designs, such as U.S. Pat. No. 8,661,715 B2 to Roth and U.S. Pat. No. 4,461,102 to DeVincentis limit the wearer from utilizing some of the most visually desirable fabrics due to issues arising from ill-fitting interchangeable uppers as a result of employing fabrics of variable stretch.

Throughout the course of a day, uppers that rely on manual tying of laces, ribbons, strings or rope to bind the foot to the sole exemplified in US 2012/0079738 A1 to Alberi and FIG. 4 of US 2013/0340285 A1 to Blowers, encounter the problem of loosening as the wearer goes about walking during the course of the day which will alter and compromise fit requiring the wearer to stop and re-tie to regain proper binding and fit.

SUMMARY OF THE INVENTION

The present invention solves the problems of prior art as referenced above. There is a need for an article of footwear that allows a wearer to achieve many more fashionable aesthetic appearances in one shoe/sandal than is currently provided by easily and quickly interchanging decorative ornaments and reversible straps over the top of permanently affixed straps. Such a functional design enables a wearer to match many outfits without the financial burden of buying many pairs of shoes/sandals, travel with many style options without having to carry many individual pairs of shoes, store footwear more efficiently, and ensure consistent fit and protection of the soft tissues of the foot from hard or abrasive surfaces of materials that can be used to make attachment devices and interchangeable reversible straps. It is the object of the present invention to provide these needs.

Embodiments of the present invention are provided. In at least one exemplary embodiment, a shoe/sandal may include at least two layers of soles: 1) a top foot bed sole upon which a wearer places the foot, and 2) a lower sole that extends from the bottom of the foot bed sole to the ground; at least two permanently affixed straps: 1) a toe strap that covers the front area of the foot just behind or slightly covering the toes, and 2) an instep strap that covers the top of the foot and extends to the area on each side of the foot in front of the ankles; at least two attachment devices on each side of the shoe/sandal which are centrally positioned at the outside base of each permanently affixed toe and instep strap and comprised of a rectangular hook and elastic band of the same width which is embedded between the bottom sole and the permanently affixed strap.

In other exemplary embodiments, a shoe/sandal may include the same features as above with interchangeable reversible decorative straps secured to the attachment devices on each side of a sandal that can include different lower sole heights and shapes and a variety of interchangeable decorative strap designs displayed in both the front and reversed position.

In at least one exemplary embodiment, interchangeable reversible decorative straps are displayed separately or as a set of straps (a set of two instep straps and two toe straps to decorate a pair of sandals), with the straps having a first end comprising a straight edge and two opposing openings formed by a loop of folded over material that is sewn together on each strap end and a second end comprising a straight edge and two opposing openings formed by said loop.

According to at least one exemplary embodiment, a dual-purpose rivet which serves as a place-holder for interchangeable reversible decorative instep straps as well as an attachment device for interchangeable ornaments may be disclosed. The dual-purpose rivet may be unattached to a permanently affixed instep strap at the bottom center of the permanent instep strap, allowing the ornament to drape over the top of the foot while not swaying back and forth due to its two loop design.

BRIEF DESCRIPTIONS OF THE FIGURES

FIG. 1*a* is a three-quarter perspective side view of a sandal with interchangeable decorative straps and an ornament fully attached.

FIG. 1*b* is a top view of a sandal with interchangeable decorative straps and an ornament fully attached.

FIG. 2*a* is a three-quarter perspective side view of a sandal without any interchangeable decorative straps or ornament(s) attached.

FIG. 2*b* is a top view of a sandal without any interchangeable decorative straps or ornament(s) attached.

FIG. 3*a* is a top view of an interchangeable reversible decorative instep strap showing the top side of the strap.

Figure 3B:
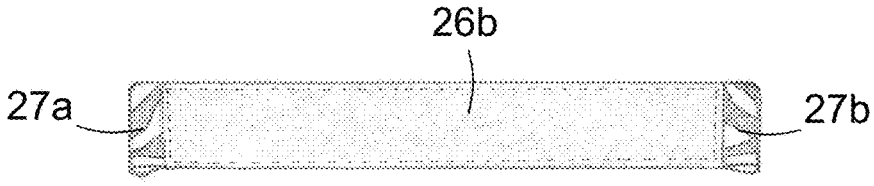

FIG. 3*b* is a top view of an interchangeable reversible decorative instep strap showing the bottom or reverse side of the strap depicted in FIG. 3*a*.

Figure 3C:
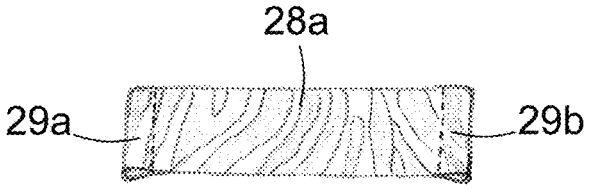

FIG. 3*c* is a top view of an interchangeable reversible decorative toe strap showing the top side of the strap.

Figure 3D:
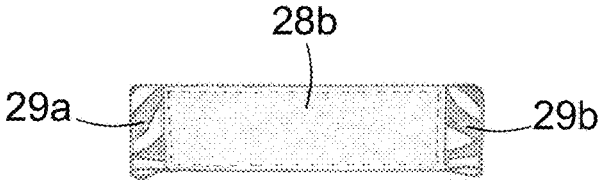

FIG. 3*d* is a top view of an interchangeable reversible decorative toe strap showing the bottom or reverse side of the strap depicted in FIG. 3*c*.

Figure 3E:
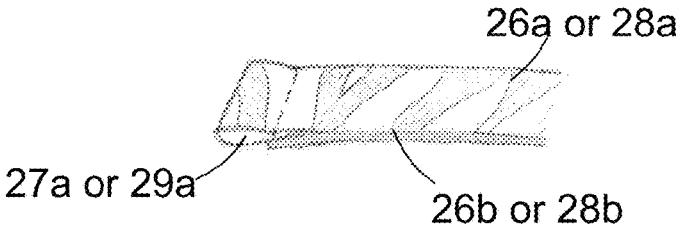

FIG. 3*e* is an angled perspective view of an interchangeable reversible decorative instep or toe strap showing the assembly of the top and bottom layers of the strap in one view.

Figure 3F:
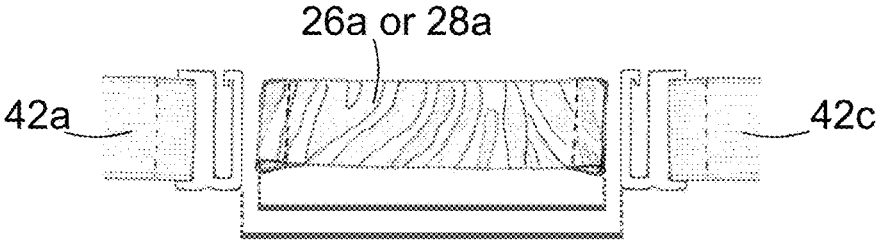

FIG. 3*f* is a top view of an interchangeable reversible decorative toe strap showing the strap has less length than the distance between the top edges of the two opposing attachment devices.

Figure 4A:
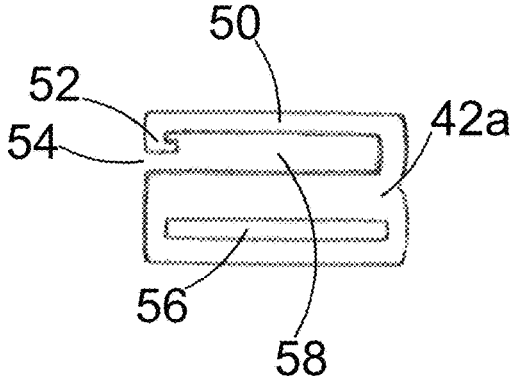

FIG. 4*a* is a frontal or top view of a rectangular hook which is the upper portion of the interchangeable reversible decorative strap attachment device.

Figure 4B:
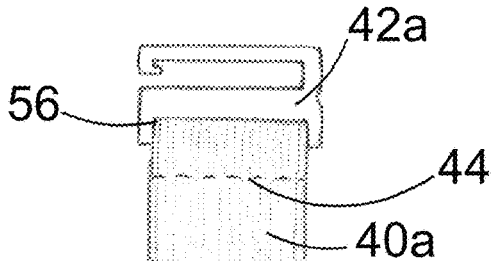

FIG. 4*b* is a frontal or top view of the entire interchangeable reversible decorative strap attachment device, including the rectangular hook and the elastic band.

Figure 4C:
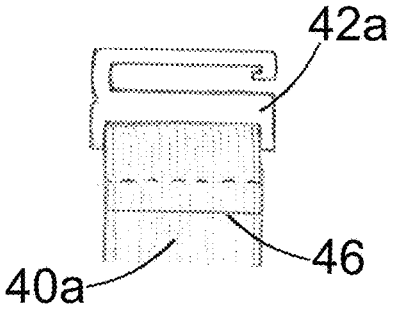

FIG. 4*c* is a reverse or underside view of the entire interchangeable reversible decorative strap attachment device.

Figure 4D:
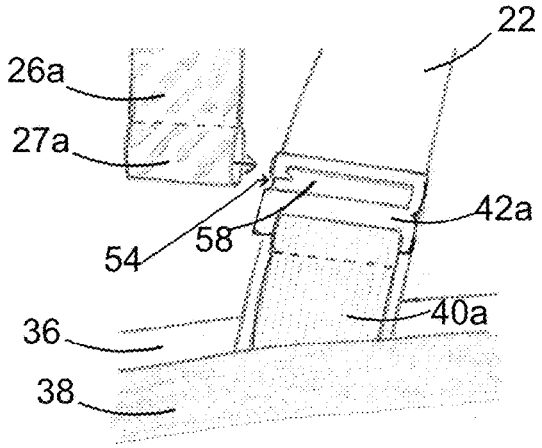

FIG. 4*d* is a view of the entire attachment device centrally positioned over the top of the permanently affixed strap with the elastic band embedded between the permanent strap and the bottom sole, as well as an interchangeable reversible decorative strap in position to be inserted onto the attachment device.

Figure 4E:
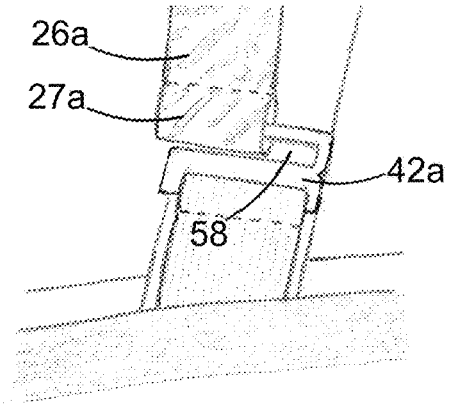

FIG. 4*e* is the same view as FIG. 4*d*, except the interchangeable reversible decorative strap is half way inserted onto the attachment device.

Figure 4F:
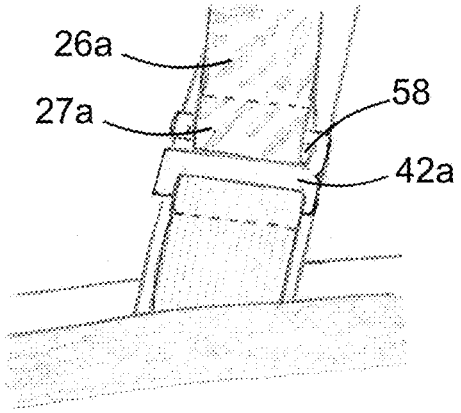

FIG. 4*f* is the same view as FIG. 4*e*, except the interchangeable reversible decorative strap is fully inserted onto the attachment device.

Figure 4G:
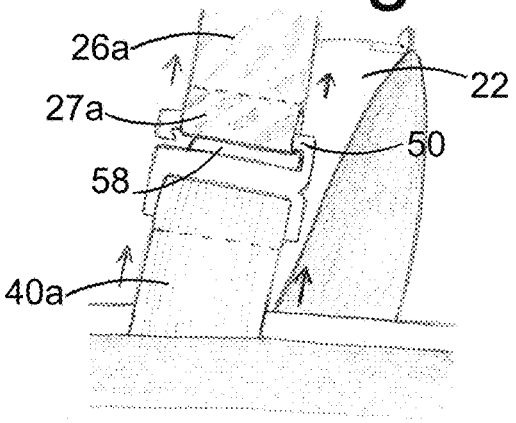

FIG. 4*g* is the same view as FIG. 4*f*, except the interchangeable reversible decorative strap has been lifted into the uppermost portion of the hook channel, stretching the elastic portion of the attachment device and preparing the interchangeable strap to be stretched over the permanently affixed instep strap.

Figure 4H:
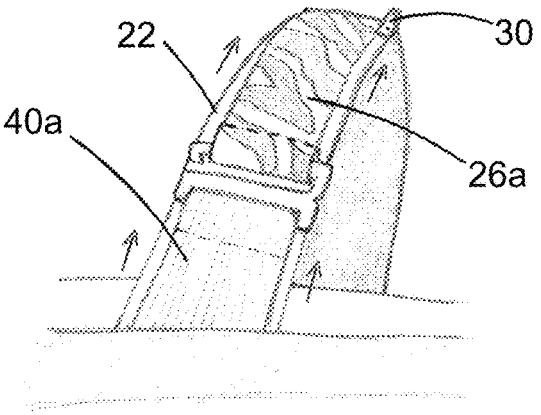

FIG. 4*h* is the same view as FIG. 4*g*, except the interchangeable reversible decorative strap has been stretched and centrally aligned over the top of the permanent affixed strap and attached to the opposing attachment device on the other side of the sandal, creating a snug fit due to the shorter length of the interchangeable strap compared to the length of the distance between the two opposing attachment devices.

Figure 4I:
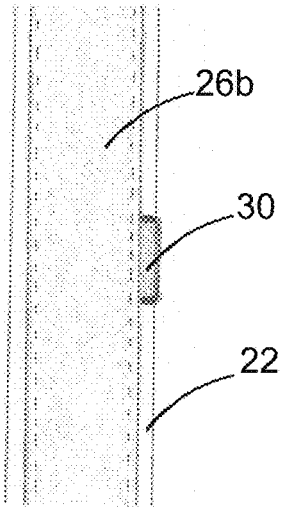

FIG. 4*i* is a top view of the reverse side of an interchangeable reversible decorative instep strap assembled on top of the permanently affixed instep strap kept centrally aligned by the dual purpose rivet.

Figure 4J:
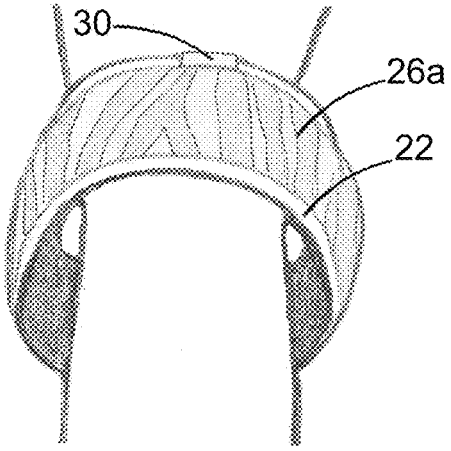

FIG. 4*j* is a top angled view showing a snugly fit and centrally aligned interchangeable reversible decorative instep strap fully assembled on top of a permanently affixed instep strap.

Figure 5A:
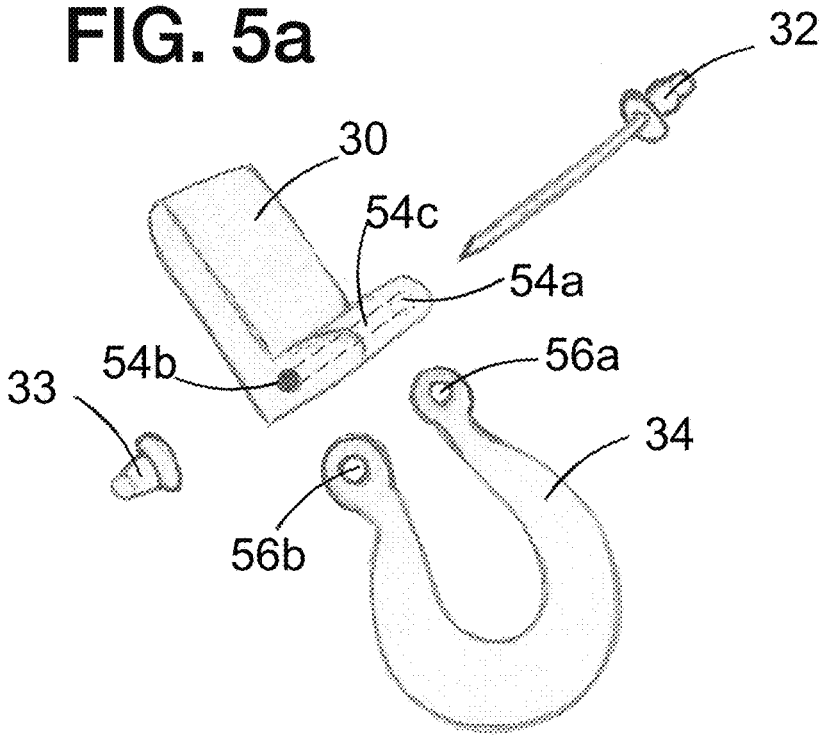

FIG. 5*a* is an overhead angled view illustrating the interchangeable ornament and its unassembled components.

Figure 5B:
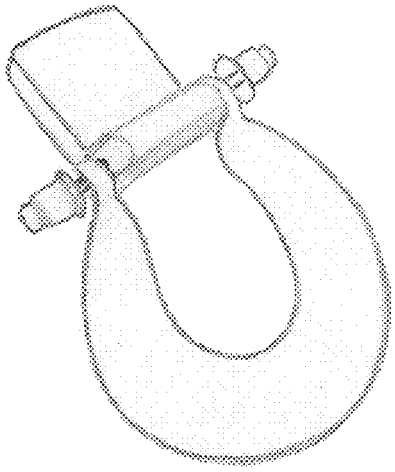

FIG. 5*b* is an angled perspective view illustrating the interchangeable ornament and its components assembled onto the dual purpose rivet.

Figure 5C:
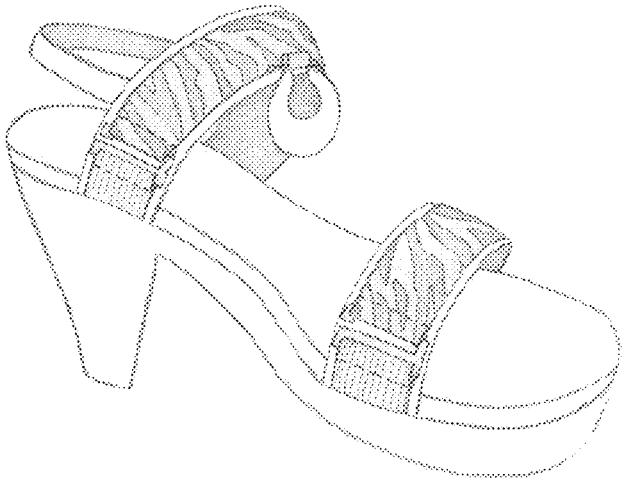

FIG. 5*c* is a three quarter perspective view of a sandal with interchangeable reversible decorative straps and ornament fully attached.

Figure 6A:
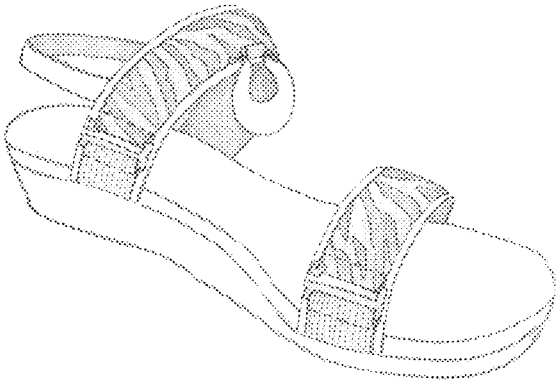

FIG. 6*a* is a perspective view of the present invention with a flat or shallow sole.

Figure 6B:
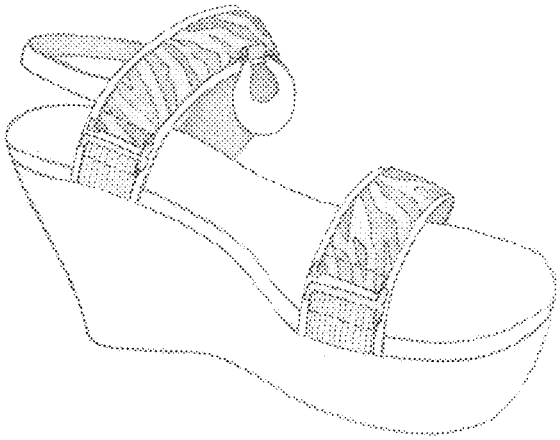

FIG. 6*b* is a perspective view of the present invention with a wedge or platform style sole.

Figure 6C:
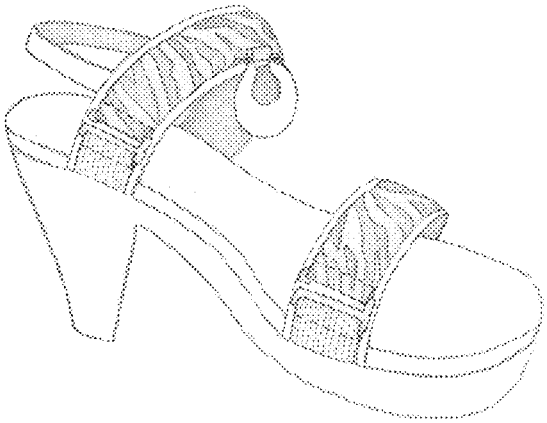
Figure 7A:
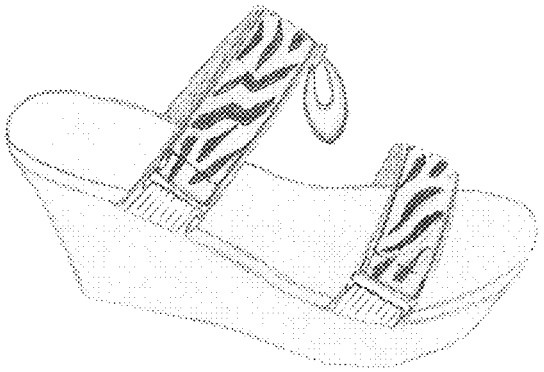
Figure 7B:
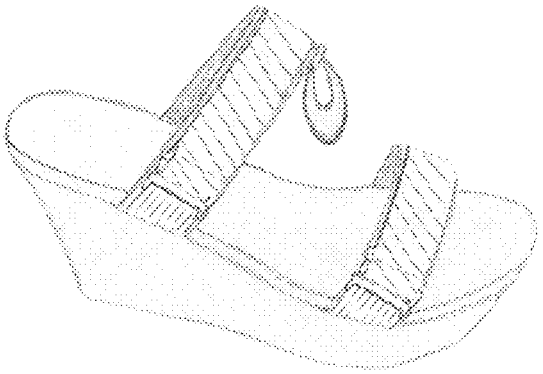
Figure 7C:
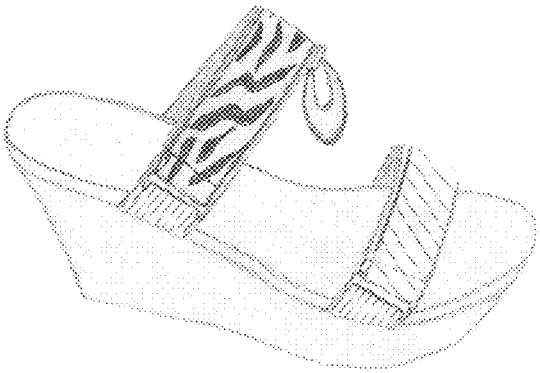
Figure 7D:
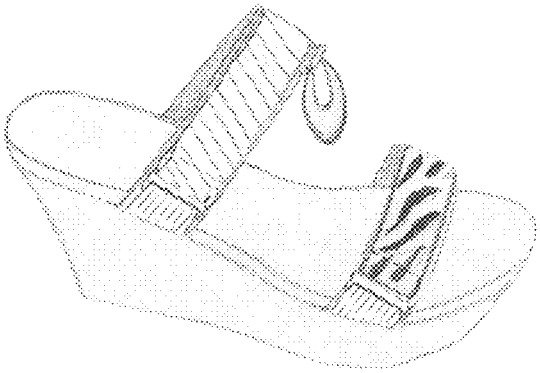

FIG. 6*c* is a perspective view of the present invention with heel style sole.

FIGS. 7*a*, 7*b*, 7*c*, and 7*d* illustrate four different views of the present invention depicting four different configurations of one set of interchangeable reversible decorative straps.

DETAILED DESCRIPTIONS OF THE INVENTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used here in, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments", or "invention", do not require that all embodiments of the invention include the discussed future advantage or mode of operation.

Advantages of embodiments of the present invention will be apparent from the following detailed descriptions of the exemplary embodiments. The following detailed descriptions should be considered in conjunction with the accompanying figures.

Turning to FIGS. 1*a-b*, 2*a-b* a first exemplary embodiment of a shoe/sandal with interchangeable straps and ornaments may be disclosed. The shoe/sandal may include an upper foot bed sole 36 upon which a wearer places the foot and that can be of any general foot shape and made of soft material that cushions the foot; a lower sole 38 which can be made of any study material such as wood, polyurethane or plastic that can withstand the weight of the body when standing and walking on it and made of any height or heel or wedge style, extending from the bottom of the foot bed sole to the ground and having an upper peripheral shape that conforms to the shape of the foot bed sole 36; a permanently affixed toe strap 24 which can be made of common materials used in shoe making such as leather, polyurethane, and other soft fabrics, and that covers the area of the foot just behind or slightly covering the base of the toes, thereby offering a consistent fit to the wearer, as well as protection from any hard or abrasive surfaces of the interchangeable reversible decorative toe strap 28*a* which can be assembled on top of permanently affixed toe strap 24, allowing a user to change the aesthetic appearance of the shoe/sandal to match their clothing or accessories; a permanently affixed instep strap 22 which can be made of common materials used in shoe making such as leather, polyurethane, and other soft fabrics and that covers the top of the foot and extends to the area on each side of the foot in front of the ankles, thereby offering a consistent fit to the wearer, as well as protection from any hard or abrasive surfaces of an interchangeable reversible decorative instep strap 26*a* which can be assembled on top of permanently affixed instep strap 22, allowing a user to change the aesthetic appearance of the shoe/sandal to match their clothing or accessories; an elastic band 40*a* which serves as the lower portion of an interchangeable reversible decorative attachment device at the inside front area of the shoe and is embedded between the lower sole 38 and the permanently affixed toe strap 24; an elastic band 40*b* which serves as the lower portion of an interchangeable reversible decorative attachment device at the inside back area of the shoe and is embedded between the lower sole 38 and the permanently affixed instep strap 22; a rectangular hook 42*a* which serves as the upper portion of the interchangeable reversible decorative attachment device located at the inside front area of the shoe and can be made of a strong materials such as metal and metal alloys to withstand the repeated use of assembly and disassembly of the interchangeable strap 28*a* and the pull incurred by the elastic band 40*a* and is the same general width of the elastic band 40*a*; a rectangular hook 42*b* which serves as the upper portion of the interchangeable reversible decorative attachment device located at the inside back area of the shoe and can be made of a strong metal material to withstand the repeated assembly and disassembly of the interchangeable strap 26*a* and the pull incurred by the elastic band 40*b* and is the same general width of the elastic band 40*b*; an interchangeable reversible decorative strap 28*a* that can be made of any materials, abrasive or soft, is attached to the rectangular hook 42*a*, stretched over the top of permanently affixed toe strap 24 and attached to the opposing interchangeable reversible decorative attachment device 42*c* located on the other side of the shoe, creating a snug fit and smooth appearance of interchangeable strap 28*a*; an interchangeable reversible decorative strap 26*a* that can be made of any materials, abrasive or soft, is attached to the rectangular hook 42*b*, stretched over the top of permanently affixed instep strap 22, centrally aligned over instep strap 22 using a dual purpose rivet 30 and attached to the opposing interchangeable reversible decorative attachment device located on the other side of the shoe, creating a snug fit and smooth appearance of the interchangeable strap 26*a*; a permanently affixed heel strap 20 which may or may not be used and has no relationship to or function in the invention; a dual purpose rivet 30 which can be made of a strong metal material, anchored at the bottom center of the permanently affixed instep strap 22 and serves as a place-holder for interchangeable straps as well as an attachment device for interchangeable ornaments; an interchangeable ornament 34 which is attached to the dual purpose rivet 30 with a pin and cap that is assembled onto the end of the pin 32.

Turning to FIGS. 3*a-f*, an exemplary embodiment of interchangeable reversible decorative straps may be disclosed. An interchangeable reversible decorative instep strap 26*a* may be made of soft or abrasive materials and include a front side with a specific decorative pattern, a first end with material folder over at the end of the strap and a seam sewn at an appropriate distance to create a loop with a straight edge 27*a*, and a second end with material folder over at the end of the strap and a seam sewn at an appropriate distance to create a loop with a straight edge 27*b*. 26*b* is the same interchangeable reversible decorative instep strap 27*b* but turned over to display the reverse side. The materials on the reverse side 26*b* may be made of soft or abrasive materials and include a different specific decorative pattern as compared to the specific decorative pattern displayed on 26*a*. The length of the material used for the central portion of the reverse side 26*b* is shorter than the length of the material used to create the entire strap including loops of the front side 26*a*, therefore loops 27*a* and 27*b* displayed on the reverse side 26*b* are simply the reverse side of the same loops displayed on the strap 26*a*.

An interchangeable reversible decorative toe strap 28*a* may be made of soft or abrasive materials and include a front side with a specific decorative pattern, a first end with material folder over at the end of the strap and a seam sewn at an appropriate distance to create a loop with a straight edge 29*a*, and a second end with material folder over at the end of the strap and a seam sewn at an appropriate distance to create a loop with a straight edge 29*b*. 28*b* is the same interchangeable reversible decorative toe strap 28*a* but turned over to display the reverse side. The materials on the reverse side 28*b* may be made of soft or abrasive materials and include a different specific decorative pattern as compared to the specific decorative pattern displayed on 28*a*. The length of the material used for the central portion of the reverse side 28*b* is shorter than the length of the material used to create the entire strap including loops of the front side 28*a*, therefore loops 29*a* and 29*b* displayed on the reverse side 28*b* are simply the reverse side of the same loops displayed on the strap 28*a*. The design of the interchangeable reversible decorative straps with straight edge loops on each end of the straps and two different materials to choose from when displaying the interchangeable straps as decorations on the shoe/sandal enables a plurality of aesthetic appearances with only one set of straps. FIG. 3*e* shows an angled view displaying both sides of one interchangeable strap, the top material on both an interchangeable instep or toe strap 26*a* or 28*a* and the bottom or reverse material on both an interchangeable instep or toe strap 26*b* or 28*b*, as well as an angled view of the loop on one end of both an interchangeable instep or toe strap 27*a* or 29*a*. FIG. 3*f* demonstrates that the length of an interchangeable reversible decorative strap 26*a* or 28*a* is made slightly less short than the distance between attachment devices on each side of a shoe, a length which differs according to shoe size and corresponding interchangeable strap size, in order to create the stretching of elastic when the loops on both ends of an interchangeable strap are assembled on each opposing hook 42*a* or 42*c*, thereby creating a snug fit of the interchangeable strap which keeps it in place and centrally aligned over a permanently affixed strap.

Turning to FIGS. 4*a-j*, exemplary embodiments may be disclosed of the interchangeable reversible decorative strap attachment device and how it functions to improve assembly, disassembly and beauty of the shoe/sandal design. FIG. 4*a* is a front view of an exemplary embodiment of a specially designed rectangular hook 42*a* which serves as the top portion of the interchangeable reversible decorative strap attachment device. The rectangular hook 42*a* may be made of strong materials such as metal and metal alloys to enable it to withstand repeated assembly and disassembly of the interchangeable strap. The uniquely designed hook 42*a* has a straight top edge 50, a rectangular open channel 58 directly below the top edge 50, an open slot located near the bottom of the hook 56 that is the same width as the top of the open channel 58, an entrance to the open channel 54 that receives the opening of a loop on an interchangeable reversible decorative strap, and a U-shaped curl 52 directly above the entrance to the open channel 54.

FIG. 4*b* is front view of an exemplary embodiment of a full interchangeable reversible decorative strap attachment device comprised of the rectangular hook 42*a* on the upper portion of the attachment device, an elastic band 40*a* that is the same width as the slot 56 at the bottom of the rectangular hook 42*a* with the end of the elastic band being fed through the open slot 56, folded over with a straight seam 44 sewn at an appropriate distance to secure the rectangular hook to the elastic band.

FIG. 4*c* is a front view of an exemplary embodiment of a reverse view of FIG. 4*b* showing the rectangular hook 42*a*, the elastic band 40*a*, and where the end of the elastic band 46 is placed to be able to sew a seam securing the elastic band to the rectangular hook.

FIG. 4*d* is a side view of a shoe/sandal displaying a front view of an exemplary embodiment of an interchangeable strap 26*a* placed in position such that the bottom straight edge of its loop 27*a* is appropriately positioned to meet the entrance 54 of the bottom of the rectangular channel 58. The rectangular hook 42*a* is the upper portion of the attachment device, with the lower portion being the elastic band 40*a* embedded between the permanently affixed strap 22 and the lower sole 38 that is directly below the foot bed sole 36.

FIG. 4*e* is a side view of a shoe/sandal displaying a front view of an exemplary embodiment of the loop 27*a* of an interchangeable strap 26*a* fully received into the bottom portion of the rectangular channel 58 of the rectangular hook 42*a*.

FIG. 4*f* is a side view of a shoe/sandal displaying a front view of an exemplary embodiment of the loop 27*a* of an interchangeable strap 26*a* halfway assembled into the bottom portion of the rectangular channel 58 of the rectangular hook 42*a* so that it is ready to be lifted into the top portion of the rectangular channel 58.

FIG. 4*g* is a side view of a shoe/sandal displaying a front view of an exemplary embodiment of the loop 27*a* of an interchangeable strap 26*a* lifted into the upper portion of the rectangular channel 58 so that the entire straight edge of the loop 27*a* is adjacent to and lifted against the entire straight bottom edge of the top of the rectangular hook 50 with the U shaped curl 52 preventing the loop 27*a* of interchangeable strap 26*a* from sliding out of the channel and unintentionally disengaging from the hook. Lifting the interchangeable strap 26*a* into the upper portion of the rectangular channel 58 stretches the elastic band 40*a* allowing the interchangeable strap 26*a* which is slightly less long than the distance between the opposing attachment devices on each side of the shoe to more easily meet the opposing attachment device on the other side of the shoe during assembly and to more easily disassemble the interchangeable strap 26*a* when intentional disassembly is desired.

FIG. 4*h* is a side view of a shoe/sandal displaying an interchangeable reversible decorative strap 26*a* fully assembled over the top of the permanently affixed instep strap 22. The interchangeable reversible decorative strap 26*a* is kept in a centrally aligned position over the permanently affixed instep strap 22 due the placement of the dual purpose rivet 30 and the snug fit achieved by the tug of the stretched elastic band 40*a* and the tug of the stretched elastic band on the opposing side of the shoe due to the interchangeable strap 26*a* being slightly less long than the distance between the two opposing rectangular hooks and being attached to the rectangular hook on the opposing side of the shoe. The dual purpose rivet 30 is embedded at the highest point and at right edge of the permanently affixed instep strap 22 because the instep of the foot slopes downward toward the front area of the foot, creating a tilted angle of the interchangeable decorative strap 26*a* attached over the top of the permanently affixed instep strap 22, making the interchangeable strap 26*a* vulnerable to dropping below the permanently affixed instep strap 22. Although the elastic bands on each side of the shoe enable an interchangeable strap to have a snug fit which can keep the interchangeable instep strap from dropping below the permanently affixed instep strap, the dual purpose rivet serves as an added guard against the interchangeable strap dropping below the permanently affixed instep strap while at the same time serving as an attachment device for a decorative ornament.

FIG. 4*i* is a close up, overhead view of interchangeable reversible decorative strap 26*b* (the reverse side of 26*a*) centrally aligned over the top of a permanently affixed instep strap 22 with the dual purpose rivet 30 embedded along the front edge of the permanently affixed instep strap 22.

FIG. 4*j* is an overhead view of a shoe/sandal showing the interchangeable reversible decorative strap 26*a* fully assembled over the top of the permanently affixed instep strap 22 with a snug fit from the pull of the elastic band at the base of each side of the permanently affixed instep strap 22 and kept in a centrally aligned position over the permanently affixed instep strap 22 due the placement of the dual purpose rivet 30 along the front edge of the permanently affixed instep strap 22.

FIG. 5*a* is an overhead angled view of the individual components of the interchangeable ornament of the present invention's shoe/sandal system. 30 is a dual purpose rivet that serves two functions. 1) when embedded along the central front edge of a permanently affixed instep strap, it keeps any interchangeable reversible decorative instep strap in central alignment over the top of a permanently affixed instep strap to achieve aesthetic beauty and stop the interchangeable decorative strap from dropping below the permanently affixed instep strap, and 2) it serves as an attachment device for a variety of interchangeable ornaments of the shoe/sandal system. An ornament 34 with parallel arms that have a loop on the end of one arm 56*a* and a loop on the end of the other arm 56*b* is positioned so that the holes on each arm are in alignment with the holes on each side of the base of the dual purpose rivet. i.e. 56*b* is aligned with 54*b* on one side and 56*a* is aligned with 54*a* on the other side. A straight pin with a permanently affixed decorative head is then inserted into the aligned holes 56*a* and 54*a*, pushed through the tunnel 54*c* between the rivet holes 54*b* and 54*a*, and exits out the aligned holes 54*b* and 56*b*. An independent decorative cap 33 is then pushed onto the point of the pin sticking out of the holes 54*b* and 56*b* to secure the ornament 34 onto the dual purpose rivet 30. This design of the ornaments with two arms surrounding the base of a rivet enables an ornament to be attached securely to a shoe/sandal and stay in a fixed position without swaying or swinging back and forth when the wearer of the shoe/sandal is walking, enhancing the beauty and comfort of the design.

FIG. 5*b* is an overhead angled view of all the components of the interchangeable ornament system assembled together.

FIG. 5*c* is three-quartered angled view of the present invention's complete design showing interchangeable reversible decorative straps attached over the top of permanently affixed straps and an interchangeable decorative ornament attached to the dual purpose rivet.

FIGS. 6*a-c* demonstrate a shoe/sandal system that has a consistent permanently affixed strap design and a plurality of lower portion sole styles of the shoe/sandal. This allows one set of the interchangeable reversible decorative straps and ornaments to be attached over the top of the consistent permanently affixed straps no matter what the lower heel sole style. 6*a* is an exemplary embodiment of a short wedge style sandal with interchangeable reversible decorative straps attached over the top of permanently affixed straps. An ornament is attached to the dual purpose rivet embedded into the permanently affixed instep strap. 6*b* is an exemplary embodiment of a tall wedge style sandal with interchangeable reversible decorative straps attached over the top of permanently affixed straps. An ornament is attached to the dual purpose rivet embedded into the permanently affixed instep strap. 6*c* is an exemplary embodiment of a heel style sandal with interchangeable reversible decorative straps attached over the top of permanently affixed straps. An ornament is attached to the dual purpose rivet embedded into the permanently affixed instep strap.

FIGS. 7*a-d* are exemplary embodiments of one wedge style sandal demonstrating 4 different stylizations when different combinations of one set of interchangeable reversible decorative straps are attached over the top of the permanently affixed straps. An ornament is attached to the dual purpose rivet embedded into the permanently affixed instep strap. 7*a* is an exemplary embodiment of a wedge style sandal with interchangeable reversible decorative straps attached over the top of permanently affixed straps and an ornament attached to the dual purpose rivet embedded into the permanently affixed instep strap. The interchangeable reversible decorative straps are configured with Side A displayed on both the instep strap and the toe strap. 7*b* is an exemplary embodiment of a wedge style sandal with interchangeable reversible decorative straps attached over the top of permanently affixed straps and an ornament attached to the dual purpose rivet embedded into the permanently affixed instep strap. The interchangeable reversible decorative straps are configured with Side B, the reverse side of Side A, displayed on both the instep strap and the toe strap. 7*c* is an exemplary embodiment of a wedge style sandal with interchangeable reversible decorative straps attached over the top of permanently affixed straps and an ornament attached to the dual purpose rivet embedded into the permanently affixed instep strap. The interchangeable reversible decorative straps are configured with Side A on the instep strap and Side B on the toe strap. 7*d* is an exemplary embodiment of a wedge style sandal with interchangeable reversible decorative straps attached over the top of permanently affixed straps and an ornament attached to the dual purpose rivet embedded into the permanently affixed instep strap. The interchangeable reversible decorative straps are configured with Side B on the instep strap and Side A on the toe strap.

What is claimed is:

1. A shoe/sandal system comprising:

a) a sole having an upper EVA foam surface configured to support and conform to a shape of a wearer's foot, a heel region for supporting a heel portion of the wearer's foot, a central region for supporting an arch or instep portion of the wearer's foot, and a front region for supporting a toe portion of the wearer's foot, wherein the sole has opposing side edges and a lower surface opposing the upper surface and adapted to engage the ground; and b) at least two permanently affixed straps and at least two interchangeable reversible decorative straps that are configured to attach over the at least two permanently affixed straps; wherein the at least two permanently affixed straps are attached to the opposing side edges of the sole and are configured to secure the wearer's foot to the sole and prevent the at least two interchangeable decorative straps from coming in contact with the wearer's foot; the at least two permanently affixed straps including a toe strap configured to cover and secure a front area of the wearer's foot just behind or slightly covering the toe portion of the foot, and an instep strap configured to cover a top portion of the foot and extend to an area on each side of the foot in front of the ankle of the wearer;

c) wherein each of the at least two permanently affixed straps includes two opposed ends, each end including an attachment device centrally positioned at an outside base portion of each opposed end, each attachment device including an upper portion formed as a rectangular hook, and a lower portion formed as an elastic band;

d) wherein each elastic band has a first end that is embedded between the sole and the respective permanently affixed strap, a central portion configured to be grasped, stretched and twisted by fingers of the wearer, and a second end that passes through an opening at the base of the rectangular hook, said opening having a width that is the same as a width of the elastic band; wherein the second end is fed through the opening at the base of the rectangular hook and is folded over and sewn or glued to a back side of the elastic band;

e) wherein each of the at least two interchangeable reversible decorative straps includes two opposed ends that each include a loop having an opening;

f) wherein the rectangular hook has a straight top edge, a rectangular open channel directly below the top edge, and an entrance to the open channel on one side of the rectangular hook that receives the opening of the respective loop of each interchangeable reversible decorative strap;

g) wherein each of the at least two interchangeable reversible decorative straps comprises a length that is shorter than a distance between two opposing rectangular hooks when the respective interchangeable reversible decorative strap and elastic bands are in a relaxed configuration, such that when the respective interchangeable reversible decorative strap is assembled on both opposing hooks, the combined decorative strap and attachment devices create tension on the opposing elastic bands, biasing the loop on each end of the respective interchangeable strap into a top of the rectangular hook's open channel;

h) wherein each rectangular hook further comprises a U-shaped curl disposed directly above the entrance to the rectangular hook's open channel, the U-shaped curl serving as a barrier to prevent the respective interchangeable strap loop from sliding out of the channel once the respective interchangeable strap loop has been inserted into the channel;

i) wherein the stretchability of the elastic bands allows the wearer to easily change and adjust the at least two interchangeable decorative straps;

j) wherein the at least two interchangeable reversible decorative straps create a snug fit and parallel alignment over the at least two permanently affixed straps; and k) wherein the at least two interchangeable straps each have two decorative surfaces, such that each of the at least two interchangeable straps is capable of being reversibly attached to the respective attachment devices, allowing the at least two interchangeable straps to be worn in a front position or a reversed position.

2. The shoe/sandal system of claim 1, wherein the permanently affixed instep strap further comprises a dual-purpose rivet and a decorative ornament, the dual-purpose rivet attached to a bottom center portion of the permanently affixed instep strap;

wherein the dual-purpose rivet comprises a protruding base having a height that is equal to or greater than a thickness of the respective interchangeable strap attached to the permanently affixed instep strap, thereby keeping the respective interchangeable strap from dropping below the permanently affixed instep strap when the respective interchangeable strap is attached;

wherein the protruding base further comprises a horizontal tunnel formed within the base, the tunnel comprising first and second opposing tunnel entrances and configured to receive a pin or bar;

wherein the decorative ornament comprises parallel vertical arms comprising first and second opposing loops configured to receive the pin or bar;

wherein a width of the base is equal to a distance between the first and second opposing loops, such that the arms of the ornament are configured to be aligned with the horizontal tunnel when the ornament is attached;

wherein the pin or bar is inserted into the first loop, through the first tunnel entrance, through the horizontal tunnel, through the second tunnel entrance, and through the second loop, and wherein the pin or bar further includes a cap inserted on a portion of the pin or bar protruding beyond the second loop;

wherein the dual-purpose rivet, the pin or bar, and the ornament are together configured to allow the ornament to be fixed in a comfortable position flat against the top portion of the wearer's foot, and configured to prevent the ornament from swinging back and forth when the wearer is walking or moving the foot.

3. The shoe/sandal system of claim 1, wherein the decorative surfaces of the at least two interchangeable straps include a variety of colors, fabrics, or patterns, so as to give the wearer a plurality of style options and the ability to change the aesthetics of the shoe/sandal system;

wherein the at least two permanently affixed straps are configured to protect soft tissues of the wearer's foot from any uncomfortable, hard-surfaced, or abrasive materials used to manufacture the at least two interchangeable decorative straps; and wherein the sole comprises at least one of: a flat sole, a low heel or wedge, a medium heel or wedge, a high heel or wedge, and a platform sole.

* * * * *